US006572335B2

(12) United States Patent
Kuwabara et al.

(10) Patent No.: US 6,572,335 B2
(45) Date of Patent: Jun. 3, 2003

(54) GAS TURBINE COOLED STATIONARY BLADE

(75) Inventors: Masamitsu Kuwabara, Takasago (JP); Yasuoki Tomita, Takasago (JP); Akihiko Shirota, Takasago (JP); Eisaku Ito, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/800,668

(22) Filed: Mar. 8, 2001

(65) Prior Publication Data

US 2001/0021343 A1 Sep. 13, 2001

(30) Foreign Application Priority Data

Mar. 8, 2000 (JP) ..... 2000-064058

(51) Int. Cl.[7] ..... F04D 29/58
(52) U.S. Cl. ..... 416/97 R; 416/96 A
(58) Field of Search ..... 415/115; 416/97 R, 416/96 A

(56) References Cited

U.S. PATENT DOCUMENTS

| | | | | | |
|---|---|---|---|---|---|
| 3,806,276 | A | * | 4/1974 | Aspinwall | 415/115 |
| 3,844,679 | A | * | 10/1974 | Grondahl et al. | 416/95 |
| 4,017,213 | A | * | 4/1977 | Przirembel | 415/115 |
| 4,040,767 | A | * | 8/1977 | Dierberger et al. | 415/115 |
| 4,946,346 | A | * | 8/1990 | Ito | 415/115 |
| 5,344,283 | A | * | 9/1994 | Magowan et al. | 415/115 |
| 5,382,135 | A | * | 1/1995 | Green | 415/115 |
| 5,593,277 | A | * | 1/1997 | Proctor et al. | 415/115 |
| 5,609,466 | A | * | 3/1997 | North et al. | 415/115 |
| 5,688,104 | A | * | 11/1997 | Beabout | 415/115 |
| 5,779,437 | A | * | 7/1998 | Abdel-Messeh et al. | 415/115 |
| 5,820,336 | A | * | 10/1998 | Hashimoto | 415/115 |
| 5,997,245 | A | * | 12/1999 | Tomita et al. | 415/115 |
| 6,036,436 | A | * | 3/2000 | Fukuno et al. | 415/115 |
| 6,050,776 | A | | 4/2000 | Akagi et al. | |
| 6,071,075 | A | | 6/2000 | Tomita et al. | |
| 6,089,822 | A | * | 7/2000 | Fukuno | 415/115 |
| 6,092,983 | A | * | 7/2000 | Tomita et al. | 415/115 |
| 6,120,244 | A | | 9/2000 | Fukura | |
| 6,142,730 | A | * | 11/2000 | Tomita et al. | 415/114 |
| 6,190,130 | B1 | * | 2/2001 | Fukue et al. | 415/115 |
| 6,196,799 | B1 | * | 3/2001 | Fukue et al. | 416/97 R |
| 6,264,426 | B1 | * | 7/2001 | Fukuno et al. | 415/115 |

FOREIGN PATENT DOCUMENTS

| | | |
|---|---|---|
| JP | 10-238302 | 9/1998 |
| JP | 11-2103 | 1/1999 |
| JP | 11-125102 | 5/1999 |

* cited by examiner

*Primary Examiner*—Edward K. Look
*Assistant Examiner*—Dwayne White
(74) *Attorney, Agent, or Firm*—Wenderoth, Lind & Ponack, L.L.P.

(57) ABSTRACT

A gas turbine cooled stationary blade has a blade structure and outer and inner shrouds enhancing cooling efficiency and preventing the occurrence of cracks due to thermal stresses. A blade (1) wall thickness, between 75% and 100% of the blade height of a blade leading edge portion, is made thicker, and the blade (1) wall thickness of other portions is made thinner, as compared with a conventional case. Protruding ribs (4) are provided on a blade (1) convex side inner wall between 0% and 100% of the blade height. A blade (1) trailing edge opening portion is made thinner than the conventional case. Outer shroud (2) is provided with cooling passages (5*a*, 5*b*) for air flow in both side end portions. Inner shroud (3) is provided with cooling passages (9*a*, 9*b*) for air flow and cooling holes (13*a*, 13*b*) for air blow in the side end portions. With the blade (1) structure and the shroud (2, 3) cooling passages (5*a*, 5*b*, 9*a*, 9*b*) and cooling holes (13*a*, 13*b*), the cooling effect is enhanced and cracks are prevented from occurring.

6 Claims, 12 Drawing Sheets

(a)

(b)

Fig. 9 (a) (Prior Art)
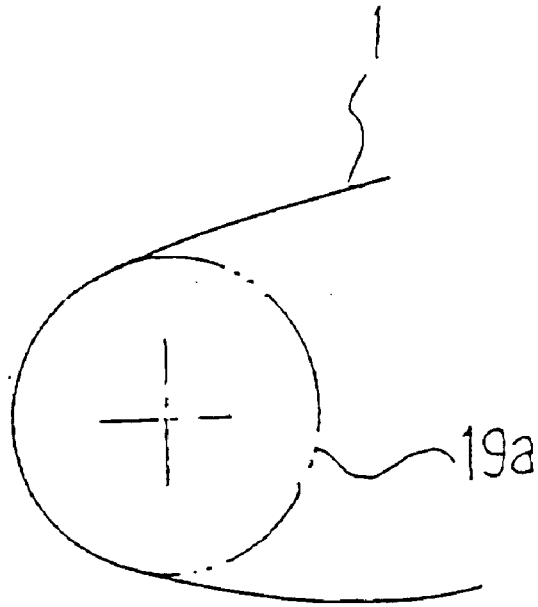
Fig. 9 (b)
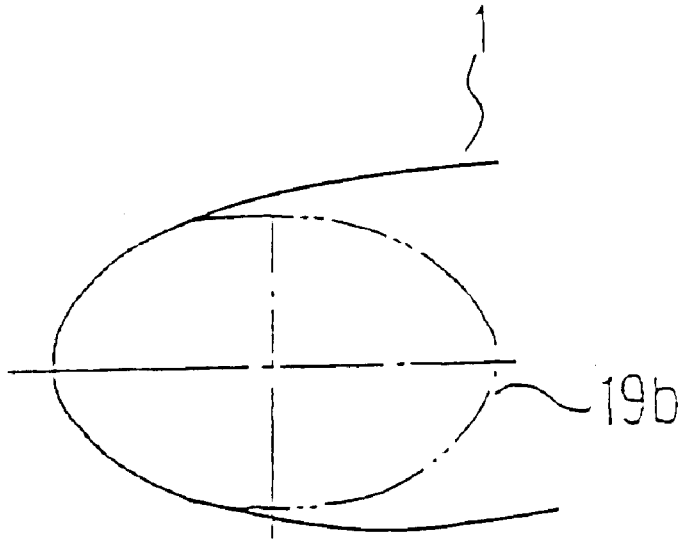

GAS TURBINE COOLED STATIONARY BLADE

BACKGROUND OF THE INVENTION

1. Field of the Invention

The present invention relates generally to a gas turbine cooled stationary blade and more particularly to a gas turbine cooled stationary blade which is suitably applied to a second stage stationary blade and is improved so as to have an enhanced strength against thermal stresses and an enhanced cooling effect.

2. Description of the Prior Art

FIG. 10 is a cross sectional view showing a gas path portion of front stages of a gas turbine in the prior art. In FIG. 10, a combustor 30 comprises a fitting flange 31, to which an outer shroud 33 and inner shroud 34 of a first stage stationary blade (1*c*) 32 are fixed. The first stage stationary blade 32 has its upper and lower ends fitted to the outer shroud 33 and inner shroud 34, respectively, so as to be fixed between them. The first stage stationary blade 32 is provided in plural pieces arranged in a turbine circumferential direction and fixed to a turbine casing on a turbine stationary side. A first stage moving blade (1*s*) 35 is provided on the downstream side of the first stage stationary blade 32 in plural pieces arranged in the turbine circumferential direction. The first stage moving blade 35 is fixed to a platform 36, and this platform 36 is fixed around a turbine rotor disc, so that the moving blade 35 rotates together with a turbine rotor. A second stage stationary blade (2*c*) 37 is provided, having its upper and lower ends fitted likewise to an outer shroud 38 and inner shroud 39, respectively, on the downstream side of the first stage moving blade 35. The second stage stationary blade is provided in plural pieces arranged in the turbine circumferential direction on the turbine stationary side. Further downstream thereof, a second stage moving blade (2*s*) 40 is provided, being fixed to the turbine rotor disc via a platform 43. Such a gas turbine as having the mentioned blade arrangement is usually constructed of four stages. A high temperature combustion gas 50 generated by combustion in the combustor 30 flows through the first stage stationary blades (1*c*) 32 and, while flowing through between the blades of the second to fourth stages, the gas expands to rotate the moving blades 35, 40, etc. to thus give rotational power to the turbine rotor, The gas 50 is then discharged.

FIG. 11 is a perspective view of the second stage stationary blade 37 mentioned with respect to FIG. 10. In FIG. 11, the second stage stationary blade 37 is fixed to the outer shroud 38 and inner shroud 39. The outer shroud 38 is formed in a rectangular shape having the periphery thereof surrounded by end flanges 38*a*, 38*b*, 38*c*, and 38*d* and a bottom plate 38*e* in a central portion thereof. Likewise, the inner shroud 39 is formed in a rectangular shape having a lower side (or inner side) peripheral portion thereof surrounded by end flanges 39*a* and 39*c* and fitting flanges 41 and 42 and a bottom plate 39*e* in a central portion thereof. Cooling of the second stage stationary blade 37 is done such that cooling air flows in from the outer shroud 38 side via an impingement plate (not shown) to enter an interior of the shroud 38 for cooling the shroud interior and then to enter an opening of an upper portion of the blade 37 to flow through blade inner passages for cooling the blade 37. The cooling air, having so cooled the blade 37, flows into an interior of the inner shroud 39 for cooling thereof and is then discharged outside.

FIG. 12 is a cross sectional view of the second stage stationary blade. In FIG. 12, numeral 61 designates a blade wall, which is usually formed to have a wall thickness of 4 mm. Within the blade, there is provided a rib 62 to form two sectioned spaces on blade leading edge and trailing edge sides. An insert 63 is inserted into the space on the blade leading edge side and an insert 64 is inserted into the space on the blade trailing edge side. Both of the inserts 63 and 64 are inserted into the spaces with a predetermined gap being maintained from an inner wall surface of the blade wall 61. A plurality of air blow holes 66 are provided in and around each of the inserts 63 and 64 so that cooling air in the blade may flow out therethrough into the gap between the blade wall 61 and the inserts 63 and 64. Also, a plurality of cooling holes 60 for blowing out the cooling air are provided in the blade wall 61 at a plurality of places of a blade leading edge portion and blade concave and convex side portions, so that the cooling air which has flowed into the gap between the blade wall 61 and the inserts 63, 64 may be blown outside of the blade for effecting shower head cooling of the blade leading edge portion and film cooling of the blade concave and convex side portions to thereby minimize the influences of the high temperature therearound.

In the gas turbine stationary blade as described above, the cooling structure is made such that cooling air flows in from the outer shroud side for cooling the interior of the outer shroud and then flows into the interior of the stationary blade for cooling the inner side and outer side of the blade, and further flows into the interior of the inner shroud for cooling the interior of the inner shroud. However, the second stage stationary blade is a blade which is exposed to high temperature, and there are problems caused by the high temperature, such as deformation of the shroud, thinning of the blade due to oxidation, peeling of the coating, the occurrence of cracks at a blade trailing edge fitting portion or a platform end face portion, etc.

SUMMARY OF THE INVENTION

In view of the problems in the gas turbine stationary blade, especially the second stage stationary blade, in the prior art, it is an object of the present invention to provide a gas turbine cooled stationary blade which is suitably applied to the second stage stationary blade and is improved in the construction and cooling structure such that a shroud or blade wall, which is exposed to a high temperature to be in a thermally severe state, may be enhanced in strength and cooling effect so that deformation due to thermal influences and the occurrence of cracks may be suppressed.

In order to achieve the object, the present invention provides the following structures (1) to (7).

(1) A gas turbine cooled stationary blade comprises an outer shroud, an inner shroud and an insert of a sleeve shape, having air blow holes, inserted into an interior of the blade between the outer and inner shrouds. The blade is constructed such that cooling air entering the outer shroud flows through the insert to be blown through the air blow holes, to be further blown outside of the blade through cooling holes provided so as to pass through a blade wall of the blade, to be led into the inner shroud for cooling thereof, and to then be discharged to the outside. A blade wall thickness in an area of 75% to 100% of a blade height of a blade leading edge portion of the blade is made thicker toward the insert than a blade wall thickness of other portions of the blade. The blade is provided therein with a plurality of ribs arranged up and down between 0% and 100% of the blade height on a blade inner wall on a blade convex side. The plurality of ribs extend in a blade transverse direction and protrude toward the insert. The outer and inner shrouds are provided therein with cooling passages arranged in shroud both side end portions on blade convex and concave sides of the respective shrouds so that cooling air may flow therethrough from a shroud front portion, or a blade leading edge side portion, of the respective shrouds to a shroud rear portion, or a blade trailing edge side portion, of the respective shrouds to then be discharged outside through openings provided in the shroud rear portion. The inner shroud is further provided therein with a plurality of cooling holes arranged along the cooling passages on the blade convex and concave sides of the inner shroud. The plurality of cooling holes communicate at one end of each hole with the cooling passages and open at the other end in a shroud side end face so that cooling air may be blown outside through the plurality of cooling holes.

(2) A gas turbine cooled stationary blade as mentioned in (1) above can have the inner shroud provided, in an entire portion of the shroud front portion, including the shroud both side end portions thereof, with a space where a plurality of erect pin fins are provided. The space communicates at the shroud both side end portions with the cooling passages on the blade convex and concave sides of the inner shroud.

(3) A gas turbine cooled stationary blade as mentioned in (1) above can have the cooling holes that are provided to pass through the blade wall provided only on the blade convex side.

(4) A gas turbine cooled stationary blade as mentioned in (1) above can have the outer and inner shrouds provided with a flange the side surface of which coincides with a shroud side end face on the blade convex and concave sides of the respective shrouds, so that two mutually adjacent shrouds in a turbine circumferential direction of the respective shrouds may be connected by a bolt and nut connection via the flange.

(5) A gas turbine cooled stationary blade as mentioned in (1) above can have a shroud thickness, near a specific place where thermal stress may easily arise, including the blade leading edge and trailing edge portions, in a blade fitting portion of the outer shroud, made thinner than a shroud thickness of other portions of the outer shroud.

(6) A gas turbine cooled stationary blade as mentioned in (1) above has the blade leading edge portion made in an elliptical cross sectional shape in the blade transverse direction.

(7) A gas turbine cooled stationary blade as mentioned in (1) above can have the gas turbine cooled stationary blade a gas turbine second stage stationary blade.

In the invention (1), the blade wall thickness in the area of 75% to 100% of the blade height of the blade leading edge portion is made thicker. Thereby, the blade leading edge portion near the blade fitting portion to the outer shroud (at 100% of the blade height), where there are severe influences of bending loads due to the high temperature and high pressure combustion gas, is reinforced and rupture of the blade is prevented. Also, the plurality of ribs are provided up and down between 0% and 100% of the blade height, extending in the blade transverse direction and protruding from the blade inner wall on the blade convex side, whereby the blade wall in this portion is reinforced and swelling of the blade is prevented. Further, the outer shroud and the inner shroud, respectively, are provided with the cooling passages in the shroud both side end portions so that cooling air entering the shroud front portion flows through the cooling passages to then be discharged outside of the shroud rear portion. Thereby, both of the side end portions on the blade convex and concave sides of the shroud are cooled effectively. Also, the inner shroud is provided with the plurality of cooling holes in the shroud both side end portions so that cooling air flowing through the insert and entering the shroud front portion is blown outside through the plurality of cooling holes. Thus, both of the side end portions on the blade convex and concave sides of the inner shroud are effectively cooled.

In the invention (1), there are provided the structure of the blade fitting portion to the outer shroud, the fitting of the plurality of ribs in the blade, the structure of the cooling passages, and the plurality of cooling holes in the outer and inner shrouds. The cooling effect of the blade fitting portion and the outer and inner shrouds is thereby enhanced and occurrence of cracks due to thermal stresses can be prevented.

In the invention (2), the space where the plurality of erect pin fins are provided is formed in the entire shroud front portion, including both side end portions of the shroud. The cooling area having the pin fins is thereby enlarged, as compared with the conventional case where there has been no such space having the pin fins in both side end portions of the shroud front portion. Thus, the cooling effect by the pin fins is enhanced and the cooling of the shroud front portion by the invention (1) is further ensured.

In the invention (3), the cooling holes of the blade are not provided on the blade concave side, but on the blade convex side only, where there are influences of the high temperature gas, whereby the cooling air can be reduced in the volume.

In the invention (4), the flange is fitted to the outer and inner shrouds. Two mutually adjacent shrouds in the turbine circumferential direction of the outer and inner shrouds, respectively, can be connected by the bolt and nut connection via the flange. The strength of fitting of the shrouds is thereby well ensured and the effect of suppressing the influences of thermal stresses by the invention (1) can be further enhanced.

In the invention (5), in the blade fitting portion where the blade is fitted to the outer shroud, the shroud thickness near the place where the thermal stress may arise easily, for example, the blade leading edge and trailing edge portions, is made thinner so that the thermal capacity of the shroud of this portion may be made smaller. The temperature difference between the blade and the shroud is thereby made smaller and the occurrence of thermal stresses can be lessened.

In the invention (6), the blade leading edge portion has an elliptical cross sectional shape in the blade transverse direction. The gas flow coming from the front stage moving blade, having a wide range of flowing angles, may be securely received, whereby the aerodynamic characteristic of the invention (1) is enhanced, imbalances in the influences of the high temperature gas are eliminated and the effects of the invention (1) can be further enhanced.

In the invention (7), the gas turbine cooled stationary blade of the present invention is used as a gas turbine second stage stationary blade and the enhanced strength against thermal stresses and the enhanced cooling effect can be efficiently obtained.

BRIEF DESCRIPTION OF THE DRAWINGS

FIGS. 9 show partial cross sectional shapes of gas turbine cooed stationary blades, wherein FIG. 9(*a*) is of a blade in the prior art and FIG. 9(*b*) is of a blade of a fourth embodiment according to the present invention.

DESCRIPTION OF THE PREFERRED EMBODIMENTS

Herebelow, embodiments according to the present invention will be described concretely with reference to figures.

Figure 1:
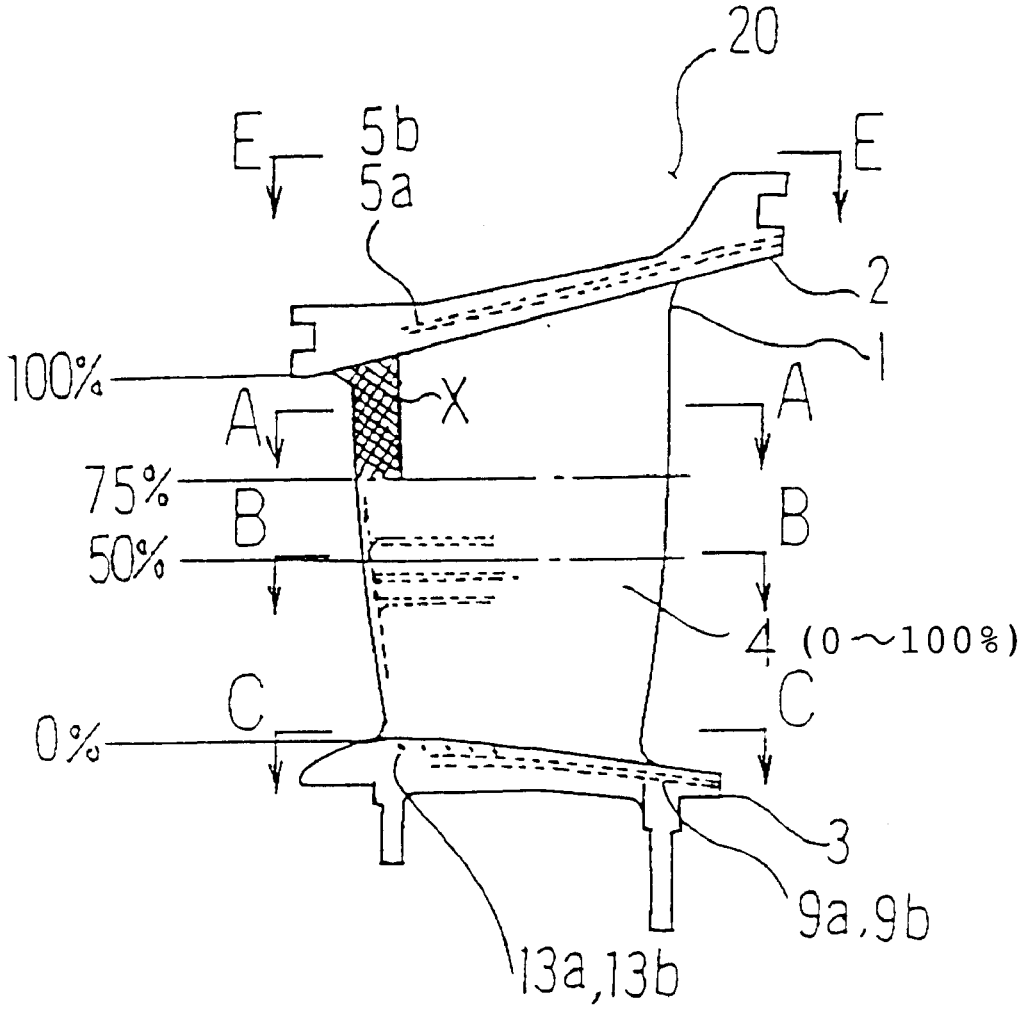
FIG. 1 is a side view of a gas turbine cooled stationary blade of a first embodiment according to the present invention.

FIGS. 1 to 6 generally show a gas turbine cooled stationary blade of a first embodiment according to the present invention. In FIG. 1, which is a side view of the blade of the first embodiment, numeral 20 designates an entire second stage stationary blade, numeral 1 designates a blade portion, numeral 2 designates an outer shroud and numeral 3 designates an inner shroud. A portion shown by X is an area of a blade leading edge portion positioned between 100% and 75% of a blade height of the blade leading edge portion, where 0% of the blade height is a position of a blade fitting portion to the inner shroud 3 and 100% of the blade height is a position of the blade fitting portion to the outer shroud 2, as shown in FIG. 1. In the area X, a blade wall thickness is made thicker than a conventional case, as described below. This is for the reason to reinforce the blade in order to avoid a rupture of the blade, as the second stage stationary blade 20 is supported in an overhanging state where an outer side end of the blade is fixed and an inner side end thereof approaches to a turbine rotor.

Numeral 4 designates ribs, which are provided at between 0% and 100% of the blade height on a blade inner wall on a blade convex side in plural pieces with a predetermined space being maintained between the ribs. The ribs 4 extend in a blade transverse direction and protrude toward inserts 63 and 64, to be described later, or toward a blade inner side, so that the rigidity of the blade may be enhanced and swelling of the blade may be prevented.

Figure 2:
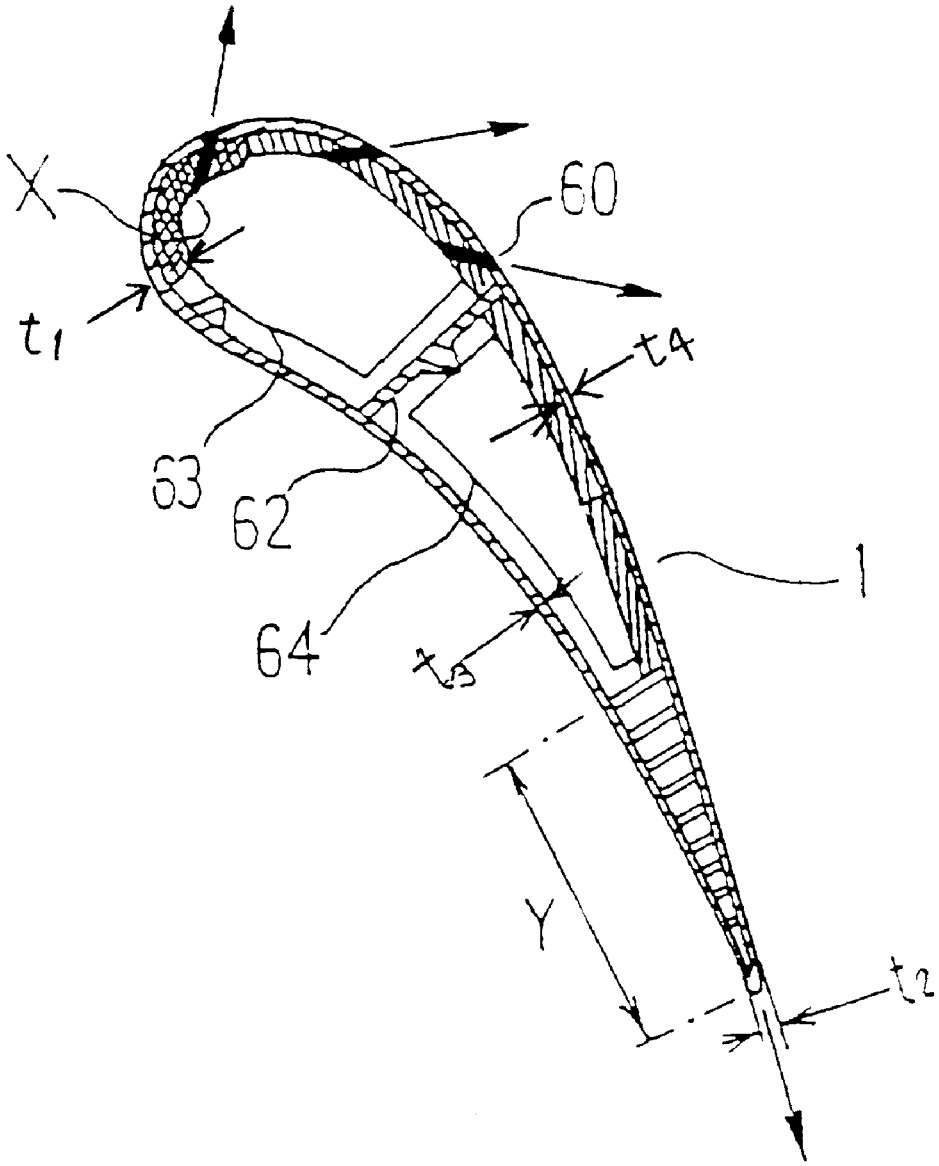
FIG. 2 is a cross sectional view taken on line A—A of FIG. 1.

FIG. 2 is a cross sectional view taken on line A—A of FIG. 1, wherein the line A—A is in the range of 75% to 100% of the blade height of the blade leading edge portion. In FIG. 2, a blade wall of the area X of the blade leading edge portion is made thicker toward the insert 63. A blade wall thickness $t_1$ of this portion is 5 mm, which is thicker than the conventional case. On the other hand, a blade trailing edge, from which cooling air is blown, is made with a thickness $t_2$ of 4.4 mm, which is thinner than the conventional case of 5.4 mm, so that aerodynamic performance therearound may be enhanced. As for other portions of the blade wall thickness, a blade wall thickness $t_3$ on a blade concave side is 3.0 mm and a blade wall thickness $t_4$ on the blade convex side is 4.0 mm, both of which are thinner than the conventional case of 4.5 mm. Moreover, a TBC (thermal barrier coating) is applied to the entire surface portion of the blade.

In a portion Y of the blade trailing edge portion, there are provided a multiplicity of pin fins. In the blade trailing edge, the pin fin has a height of 1.2 mm, a blade wall thickness there is 1.2 mm, the TBC is 0.3 mm in thickness and an undercoat therefor is 0.1 mm. Thus the thickness $t_2$ of the blade trailing edge is 4.4 mm, as mentioned above. Moreover, the cooling holes 60 which have been provided in the conventional case are provided only on the blade convex side and not on the blade concave side, so that cooling air flowing therethrough is reduced in volume.

Figures 3A, 3B:
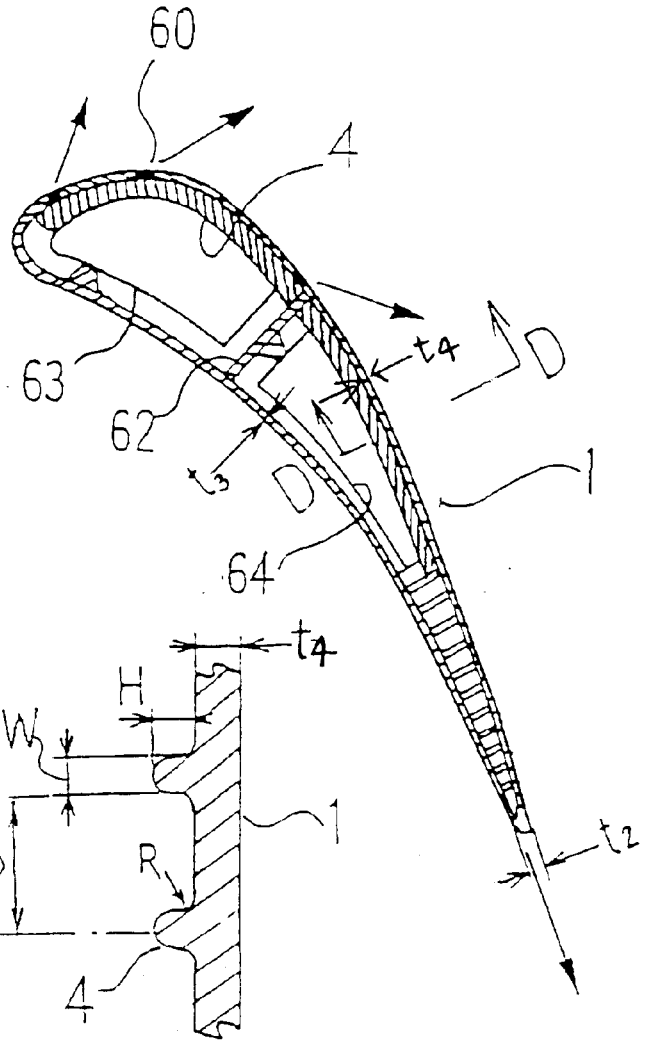
FIGS. 3 show the blade of FIG. 1, wherein FIG. 3(*a*) is a cross sectional view taken on line B—B of FIG. 1 and FIG. 3(*b*) is a cross sectional view taken on line D—D of FIG. 3(*a*).

FIG. 3(*a*) is a cross sectional view taken on line B—B of FIG. 1, wherein the line B—B is substantially at 50% of the blade height of the blade leading edge portion. FIG. 3(*b*) is a cross sectional view taken on line D—D of FIG. 3(*a*). In FIGS. 3, while the blade wall thickness $t_3$ on the blade concave side is 3.0 mm and that $t_4$ on the blade convex side is 4.0 mm, the ribs 4 on the blade inner wall on the convex side are provided so as to extend to the blade leading edge portion. In FIG. 3(*b*), the ribs 4 are provided vertically on the blade inner wall, extending in the blade transverse direction with a rib to rib pitch P of 15 mm. Each of the ribs 4 has a width or thickness W of 3.0 mm and a height H of 3.0 mm, so that the blade convex side is reinforced by the ribs 4. A tip edge of the rib 4 is chamfered and a rib fitting portion to the blade inner wall is provided with a fillet having a rounded surface R. By so providing the ribs 4 on the blade convex side, the blade is prevented from swelling toward the outside. Constructions of other portions of the blade are substantially same as those shown in FIG. 2.

Figure 4:
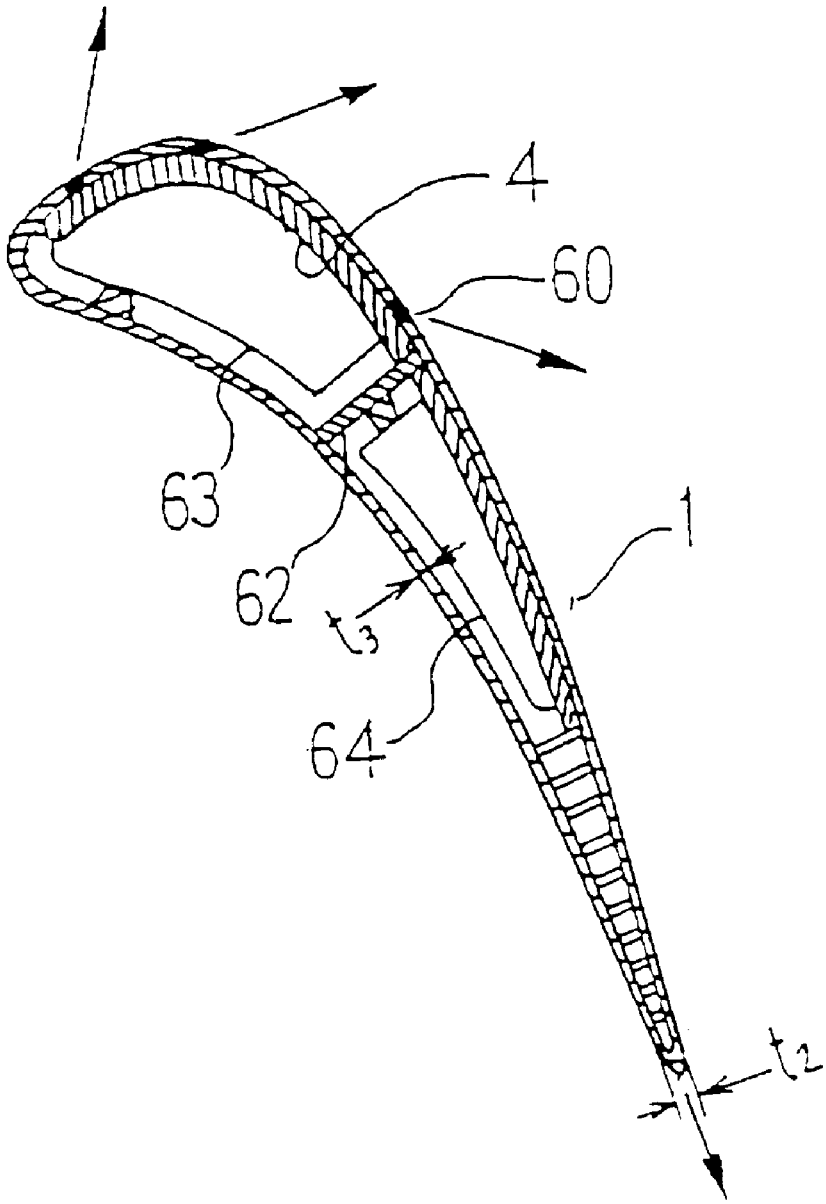
FIG. 4 is a cross sectional view taken on line C—C of FIG. 1.

FIG. 4 is a cross sectional view taken on line C—C of FIG. 1, wherein the line C—C is substantially at 0% of the blade height of the blade leading edge portion. In FIG. 4, the ribs 4 on the blade convex side are provided so as to extend to the blade leading edge portion, or the blade wall thickness on the blade convex side is made thicker, so that the blade is reinforced, and the entire structure of the blade is basically same as that of FIG. 3.

In the present first embodiment, while the cross sectional shapes of the blade shown in FIGS. 2 to 4 are gradually deformed, although not illustrated, by twisting of the blade around a blade height direction, the twisting is suppressed to a minimum and the blade wall is made as thin as possible in view of the insertability of inserts 63 and 64, which are the same as the conventional ones described above, at the time of assembly. The blade is thereby made in a twisted shape such that the inserts 63 and 64 may be inserted along the blade height direction, yet the aerodynamic performance of the blade may be enhanced.

Figure 5:
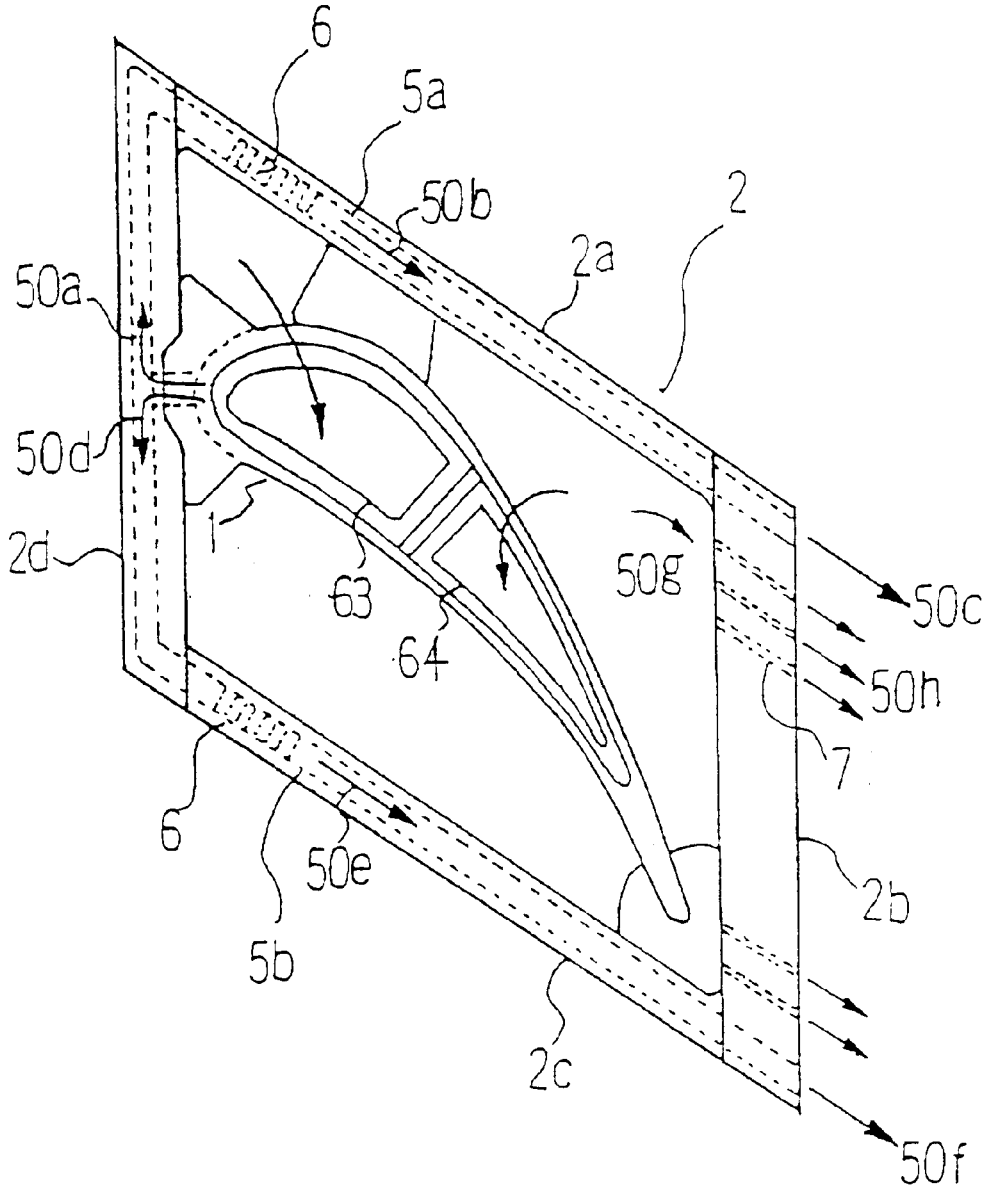
FIG. 5 is a view seen from line E—E of FIG. 1 for showing an outer shroud of the blade of FIG. 1.

FIG. 5 is a view seen from line E—E of FIG. 1 for showing the outer shroud 2 of the present first embodiment. In FIG. 5, the outer shroud 2 has its periphery surrounded by flange portions 2*a*, 2*b*, 2*c*, and 2*d* and also has its thickness tapered from a front portion, or a blade leading edge side portion, of the shroud 2, of a thickness of 17 mm, to a rear portion, or a blade trailing edge side portion, of the shroud 2, of a thickness of 5.0 mm, as partially shown in FIG. 8(*b*). In the flange portions 2*d* and 2*a*, a cooling passage 5*a* is provided extending from a central portion of the flange portion 2*d* of a shroud front end portion to a rear end of the flange portion 2*a* of one shroud side end portion, or a blade convex side end portion, of the shroud 2. Also, in the flange portions 2*d* and 2*c*, a cooling passage 5*b* is provided extending from the central portion of the flange portion 2*d* to a rear end of the flange portion 2*c* of the other shroud side end portion, or a blade concave side end portion, of the shroud 2. The respective cooling passages 5*a*, 5*b* form passages through which cooling air flows from the shroud front portion to the shroud rear portion via the shroud side end portions for cooling peripheral shroud portions and is then discharged outside of the shroud 2. Also, there are provided a multiplicity of turbulators 6 in the cooling passages 5*a* and 5*b*. Further, as in the conventional case, there are provided a multiplicity of cooling holes 7 in the flange portion 2*b* of the shroud rear end portion so as to communicate with an internal space of the shroud 2, whereby cooling air may be blown outside of the shroud 2 through the cooling holes 7.

In the outer shroud 2 constructed as above, a portion of the cooling air flowing into an interior of the shroud 2 from an outer side thereof enters a space formed by the inserts 63 and 64 of the blade 1 for cooling an interior of the blade 1 and is blown outside of the blade 1 through cooling holes provided in and around the blade 1 for cooling the blade and blade surfaces, and also flows into the inner shroud 3. The remaining portion of the cooling air which has entered the outer shroud 2 separates at the shroud front end portion, as shown by air 50*a* and 50*d*, to flow toward the shroud side end portions through the cooling passages 5*a* and 5*b*. The air 50*a* further flows through the cooling passage 5*a* on the blade convex side of the shroud 2 as air 50*b*, and is then discharged outside of the shroud rear end as air 50*c*. Also, the air 50*d* flows through the cooling passage 5*b* on the blade concave side of the shroud 2 as air 50*e*, and is then discharged outside of the shroud rear end as air 50*f*. In this process of the flow, the air 50*a*, 50*d*, 50*b*, and 50*e* is agitated by the turbulators 6 so that the shroud front end portion and shroud side end portions may be cooled with an enhanced heat transfer effect. Moreover, air 50*g* in the inner space of the shroud 2 flows outside of the shroud rear end as air 50*h* through the cooling holes 7 provided in the flange portion 2*b* of the shroud rear end portion and cools the shroud rear portion. Thus, the entirety of the outer shroud 2, including the peripheral portions thereof, are cooled efficiently by the cooling air. It is to be noted that, with respect to the outer shroud 2 also, the same cooling holes as those provided in the inner shroud described with respect to FIG. 6(*b*) may be provided in the shroud side end portions of the outer shroud 2 so as to communicate with the cooling passages 5*a* and 5*b* for blowing air through the cooling holes.

Figure 6A:
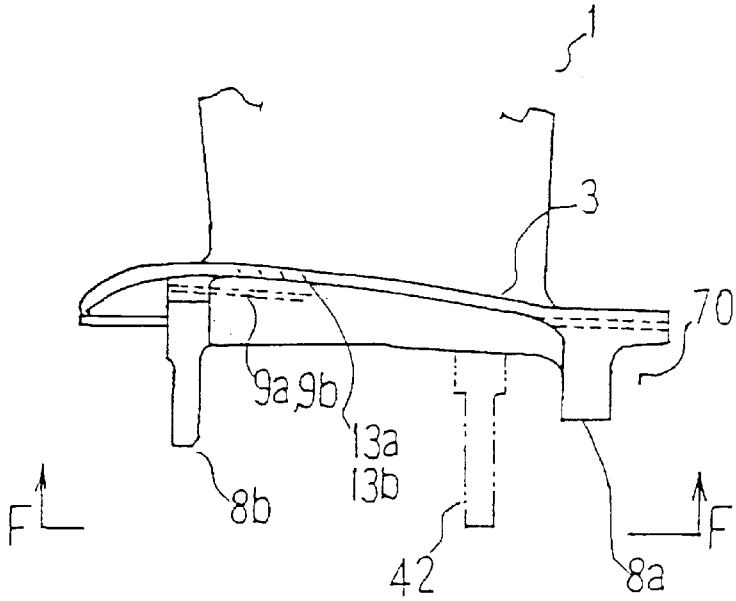
FIGS. 6 show an inner shroud of the blade of FIG. 1, wherein FIG. 6(*a*) is a side view thereof and FIG. 6(*b*) is a view seen from line F—F of FIG. 6(*a*).
Figure 6B:
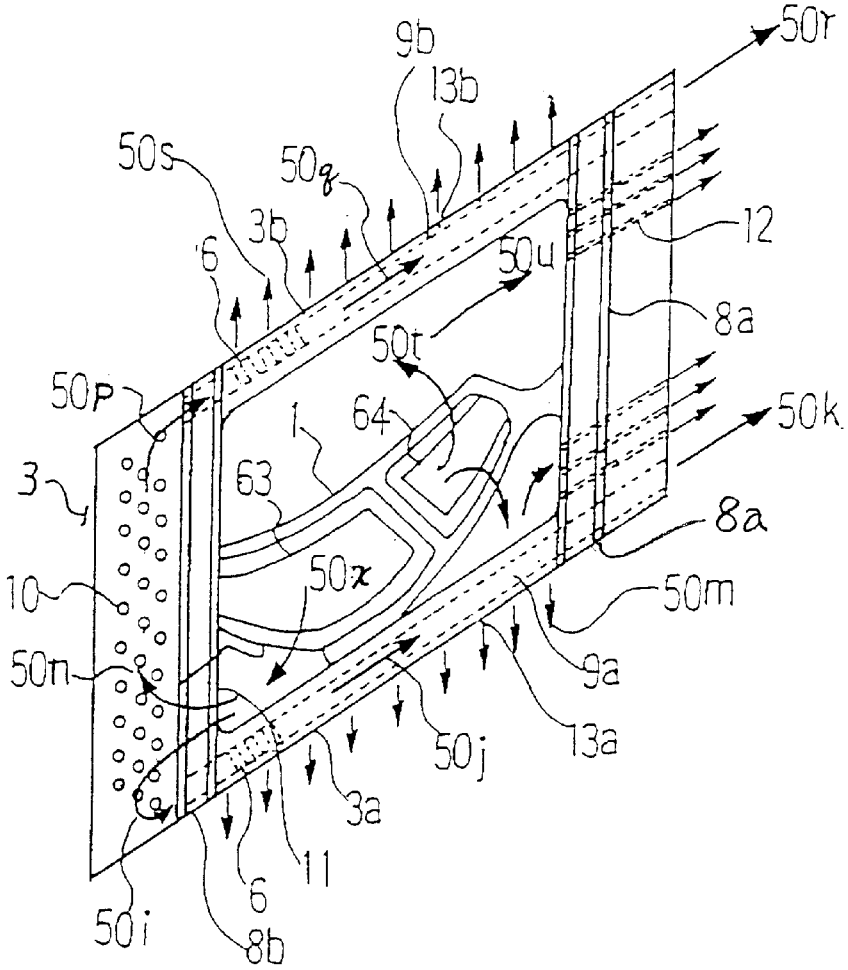

FIGS. 6 are views showing the inner shroud 3 of the present first embodiment in which FIG. 6(*a*) is a side view thereof and FIG. 6(*b*) is a view seen from line F—F of FIG. 6(*a*). In FIGS. 6(*a*) and (*b*), there are provided fitting flanges 8*a* and 8*b* for fitting a seal ring holding ring (not shown) on the inner side of the inner shroud 3. The fitting flange 8*a* of a rear end portion, or a blade trailing edge side end portion, of the shroud 3 is arranged rear of the trailing edge position of the blade 1, as compared with the conventional fitting flange 42, which is arranged forward of the trailing edge position of the blade 1. By so arranging the fitting flange 8*a*, a space 70 formed between the inner shroud 3 and an adjacent second stage moving blade on the rear side may be made narrow so as to elevate the pressure in the space 70, whereby the sealing performance there is enhanced, the high temperature combustion gas is securely prevented from flowing into the inner side of the inner shroud 3 and the cooling effect of the rear end portion of the inner shroud 3 is further enhanced.

In FIG. 6(*b*), the inner shroud 3 has its peripheral portions surrounded by flange portions 3*a*, 3*b* of the shroud end portions, or blade convex and concave side portions, of the shroud 3, as well as by the fitting flanges 8*b*, 8*a* of the shroud front and rear end portions. Forward of the fitting flange 8*b*, there is formed a pin fin space where a multiplicity of pin fins 10 are provided extending up from an inner wall surface of the inner shroud 3. In the rear end portion of the inner shroud 3 above the fitting flange 8*a*, there are provided a multiplicity of cooling holes 12 so as to communicate at one end of each hole with an inner side space of the inner shroud 3 and to open at the other end toward the outside. In the flange portions 3*a*, 3*b* on the shroud side portions, there are provided cooling passages 9*a*, 9*b*, respectively, so as to communicate with the pin fin space having the pin fins 10 and to open toward the outside of the shroud rear end portion, so that cooling air may flow therethrough from the pin fin space to the shroud rear end. The respective cooling passages 9*a*, 9*b* have a multiplicity of turbulators 6 provided therein. Also, the inner side space of the inner shroud 3 and the pin fin space communicate with each other via an opening 11. Furthermore, there are provided a multiplicity of cooling holes 13*a*, 13*b* in the flange portions 3*a*, 3*b*, respectively, so as to communicate at one end of each hole with the cooling passages 9*a*, 9*b*, respectively, and to open at the other end toward the outside of the shroud sides, so that cooling air may be blown outside therethrough.

In the inner shroud 3 constructed as mentioned above, cooling air 50*x* flowing out of a space of the insert 63 enters the pin fin space through the opening 11 and separates toward the shroud side portions as air 50*i* and 50*n*, to flow through the cooling passages 9*a* and 9*b*, as air 50*j* and 50*q*, respectively. In this flow process, the cooling air is agitated by the pin fins 10 and the turbulators 6 so that the shroud front portion and both side end portions may be cooled with an enhanced cooling effect. The cooling air flowing through the cooling passages 9*a* and 9*b* flows out of the shroud rear end as air 50*k* and 50*r*, respectively, for cooling the shroud rear end side portions and, at the same time, flows out through the cooling holes 13*a* and 13*b* communicating with the cooling passages 9*a* and 9*b*, as air 50*m* and 50*s*, respectively, for effectively cooling the shroud side portions, or the blade convex and concave side portions, of the inner shroud 3.

Also, the air flowing out of a space of the insert 64 into the inner side space of the shroud 3 as air 50*t* flows toward the shroud rear portion as air 50*u*, to be blown out through the cooling holes 12 provided in the shroud rear portion for effective cooling thereof. Thus, the inner shroud 3 is constructed such that there are provided the pin fin space having the multiplicity of pin fins 10 in the shroud front portion, the passages of the multiplicity of cooling holes 12, which are same as in the conventional case, in the shroud rear portion, and the cooling passages 9*a*, 9*b* and the multiplicity of cooling holes 13*a*, 13*b* in the shroud side portions, so that the entire peripheral portion of the shroud 3 may be effectively cooled. Moreover, the fitting flange 8*a* on the shroud rear side is provided at a rear position so that the space 70 between the shroud 3 and an adjacent moving blade on the downstream side may be made narrow, whereby the cooling of the downstream side of the shroud can be done securely.

In the gas turbine cooled blade of the present first embodiment as described above, the blade is constructed such that the leading edge portion of the blade 1 between 100% and 75% of the blade height is made thicker, the multiplicity of ribs 4 are provided on the blade inner wall on the blade convex side between 100% and 0% of the blade height, other portions of the blade are made thinner and the blade trailing edge forming air blow holes is made thinner. Also, the cooling holes of the blade from which cooling air in the blade is blown outside are provided only on the blade convex side, with the cooling holes on the blade concave side being eliminated. Also, the outer shroud 2 is provided with the cooling passages 5*a* and 5*b* on the blade convex and concave sides of the shroud, and the inner shroud 3 is provided with the pin fin space having the multiplicity of pin fins 10 in the shroud front portion as well as the cooling passages 9*a* and 9*b* and the multiplicity of cooling holes 13*a* and 13*b* on the blade convex and concave sides of the shroud. Thus, the peripheral portions and the blade fitting portions of the outer and inner shrouds 2, 3 which are under thermally severe conditions can be effectively cooled and the occurrence of cracks in these portions can be prevented.

Figure 7:
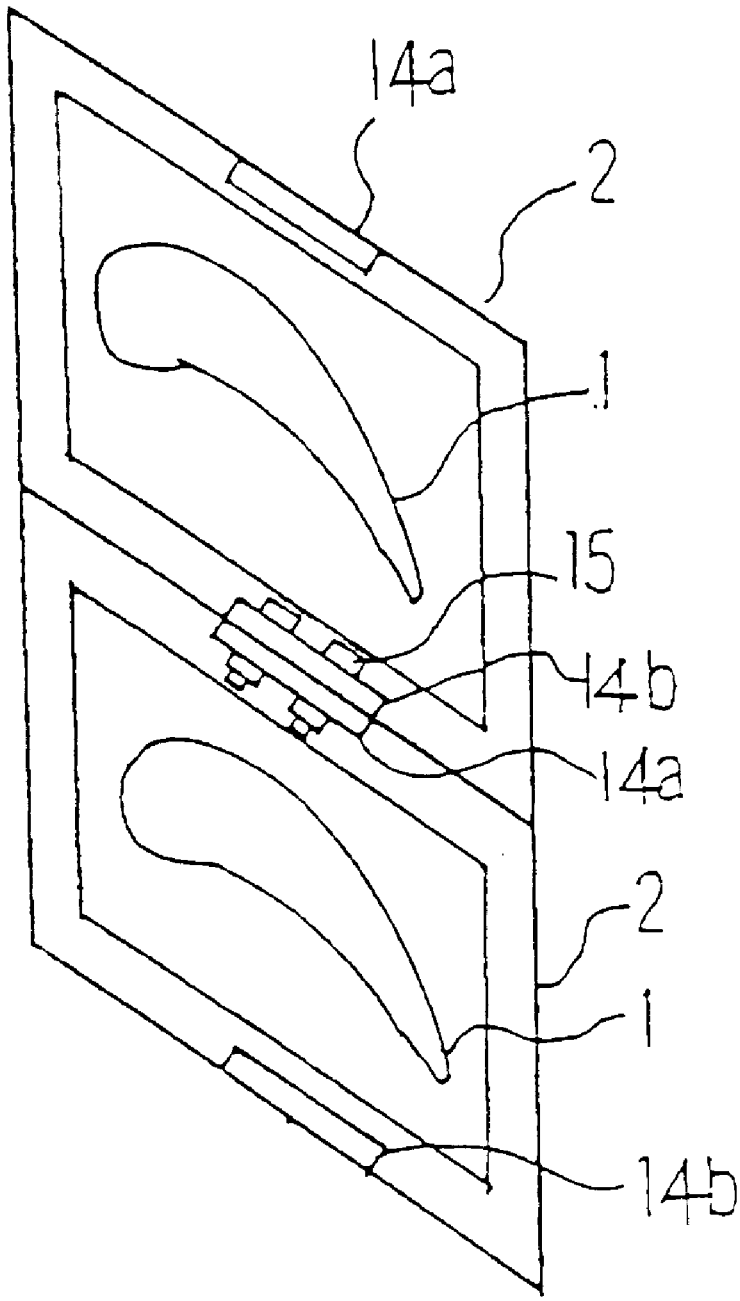
FIG. 7 is a plan view of a gas turbine cooled stationary blade of a second embodiment according to the present invention.

FIG. 7 is a plan view of a gas turbine cooled stationary blade of a second embodiment according to the present invention. In the present second embodiment, two mutually adjacent outer shrouds in a turbine circumferential direction are connected together by a flange and bolt connection so that the strength of the shrouds may be ensured. Construction of other portions of the blade is the same as that of the blade of the first embodiment. It is to be noted that the inner shrouds also may likewise be connected by the flange and bolt connection, but the description here will be made representatively by the example of the outer shroud. In FIG. 7, a flange 14*a* is fitted to a peripheral portion on the blade convex side of the outer shroud 2 and a flange 14*b* is fitted to the peripheral portion on the blade concave side of the outer shroud 2. A side surface of each flange 14*a*, 14*b* coincides with a corresponding shroud side end face, and the flanges 14*a*, 14*b* are connected together by a bolt and nut connection 15. By so connecting the two shrouds with the bolt and nut connection 15 via the flanges 14*a*, 14*b*, fitting of the outer shroud 2 to the turbine casing side can be strengthened. The strength of the blade is thereby ensured, which contributes to the prevention of creep rupture of the blade due to gas pressure. By employing the bolt and nut connection, internal restrictions between the blades are weakened, as compared with an integrally cast dual blade set, so that excessive thermal stresses at the blade fitting portion may be suppressed. Other constructions and effects of the present second embodiment being the same as in the first embodiment, detailed description thereof will be omitted.

Figure 8:
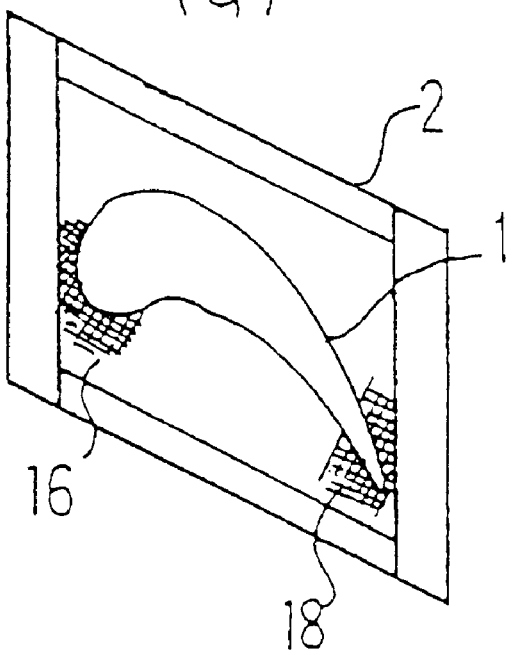
FIGS. 8 show an outer shroud of a gas turbine cooled stationary blade of a third embodiment according to the present invention, wherein FIG. 8(*a*) is a plan view thereof and FIG. 8(*b*) is a cross sectional view of a portion of the outer shroud of FIG. 8(*a*).
Figure 8:
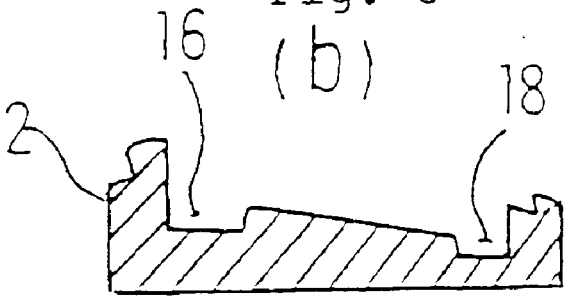
Figure 10:
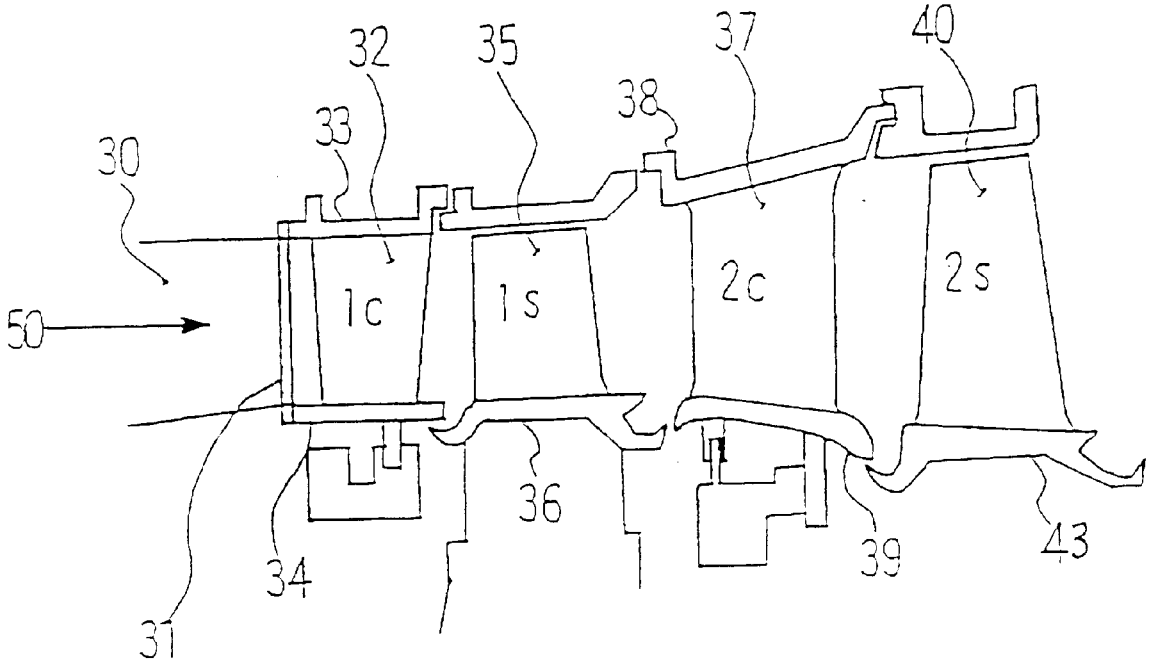
Fig. 10 (Prior Art)
FIG. 10 is a cross sectional view of a front stage gas path potion of a gas turbine in the prior art.
Figure 11:
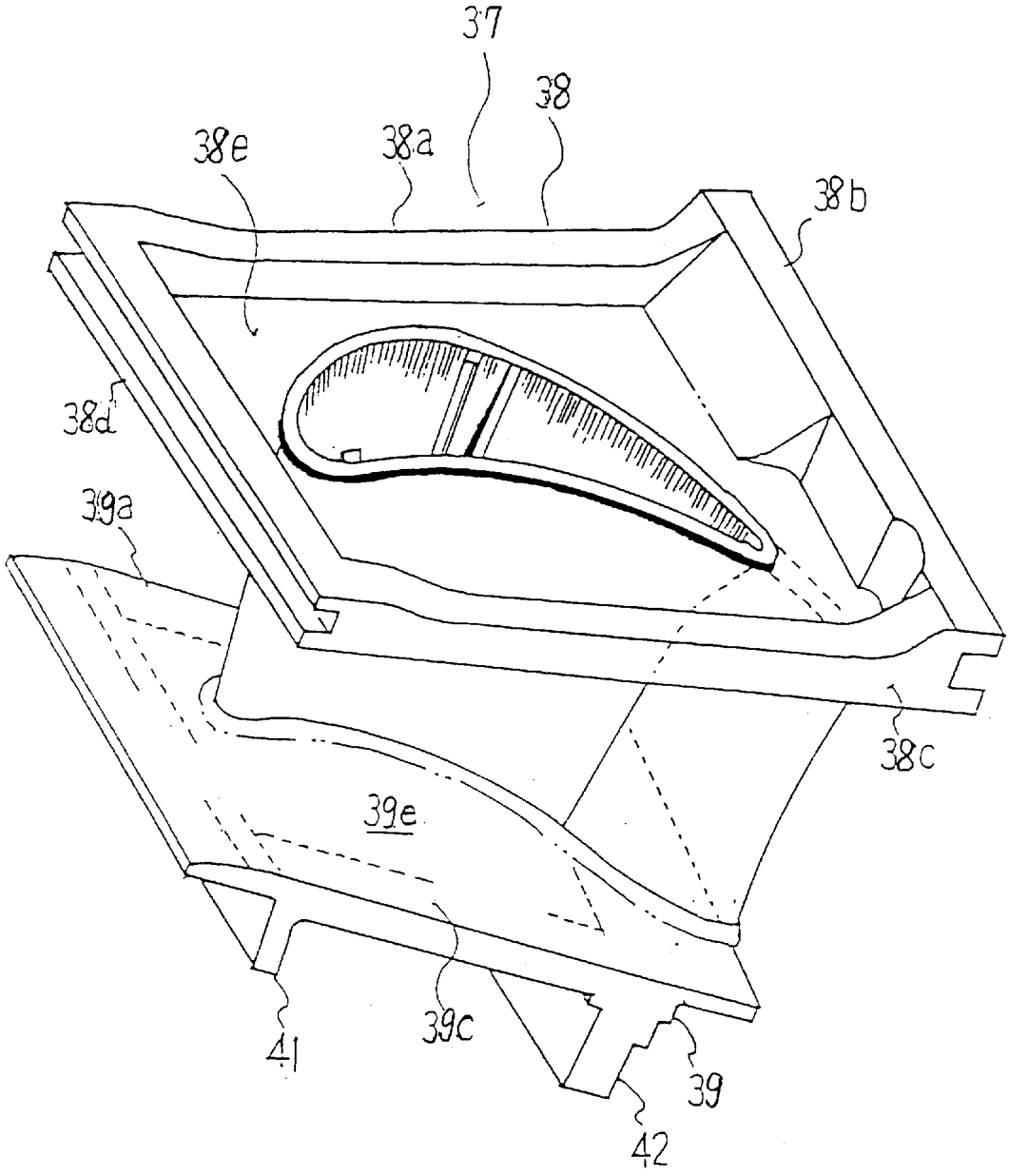
Fig. 11 (Prior Art)
FIG. 11 is a perspective view of a second stage stationary blade of the gas turbine of FIG. 10.
Figure 12:
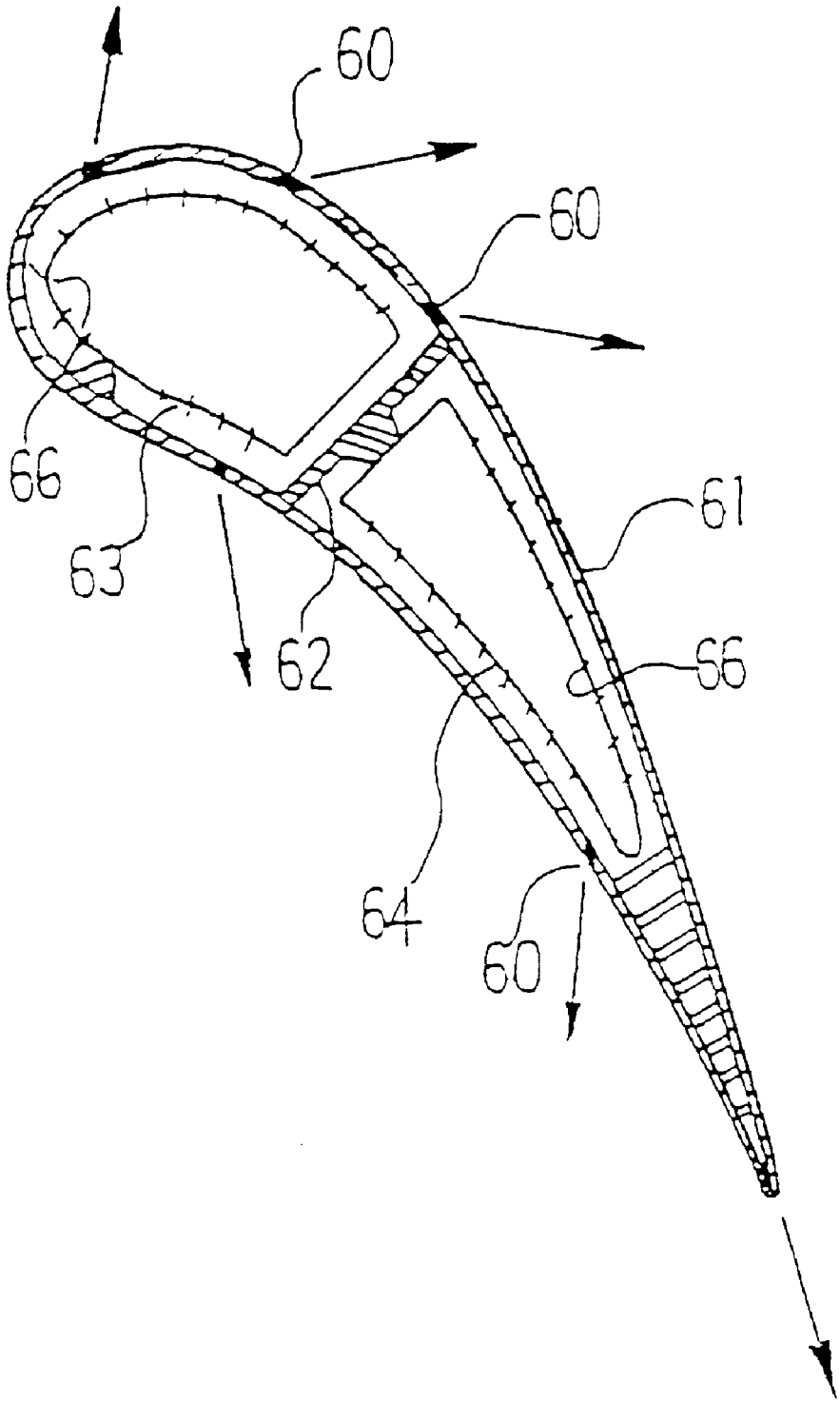
Fig. 12 (Prior Art)
FIG. 12 is a cross sectional view of the blade of FIG. 11.

FIG. 8 shows a gas turbine cooled stationary blade of a third embodiment according to the present invention. FIG. 8(*a*) is a plan view of an outer shroud thereof and FIG. 8(*b*) is a cross sectional view of the outer shroud of FIG. 8(*a*) including specific portions near a blade fitting portion. In these portions of the outer shroud, the shroud is made thinner so that rigidity there may be balanced between the blade and the shroud. Constructions of other portions of the blade of the present third embodiment are the same as those of the first embodiment. In FIGS. 8(*a*) and (*b*), a portion 16 of the outer shroud 2 near a rounded edge of the blade in the blade fitting portion on the leading edge side of the blade 1 and a portion 18 of the outer shroud 2 near a thin portion of the blade in the blade fitting portion on the trailing edge side of the blade 1 are made thinner than other portions of the outer shroud 2. By so making the portions 16, 18 of the outer shroud 2 thinner near the blade fitting portions, where there are severe thermal influences, rigidity there becomes smaller, and imbalance in the rigidity between the blade and the shroud is made smaller. Thermal stresses caused in these portions thereby become smaller and cracks caused by the thermal stress can be suppressed. It is to be noted that, although description is omitted, the same construction may be applied to the inner shroud 3. According to the present third embodiment, the cooling effect of the shroud can be further ensured beyond the effects of the first embodiment.

FIG. 9 shows partial cross sectional shapes in a blade transverse direction of gas turbine cooled stationary blades. FIG. 9(*a*) is a cross sectional view of a blade leading edge portion in the prior art and FIG. 9(*b*) is a cross sectional view of a blade leading edge portion of a fourth embodiment according to the present invention. In FIGS. 9(*a*) and (*b*), while the blade leading edge portion in the prior art is made in a circular cross sectional shape 19*a*, the blade leading edge portion of the fourth embodiment is made in an elliptical cross sectional shape 19*b* on the elliptical long axis. By employing such an elliptical cross sectional shape, the stationary blade of the present fourth embodiment may respond to any gas flow coming from a front stage moving blade, having a wide range of flow angles, and the aerodynamic performance thereof can be enhanced. Imbalances in the influences given by the high temperature combustion gas may be made smaller. Constructions and effects of other portions of the fourth embodiment being the same as those of the first embodiment, description thereof will be omitted.

While the preferred forms of the present invention have been described, it is to be understood that the invention is not limited to the particular constructions and arrangements illustrated and described, but embraces such modified forms thereof as come within the appended claims.

What is claimed is:

1. A gas turbine cooled second stage stationary blade arrangement comprising:

an outer shroud and an inner shroud, each having side portions on a blade convex side and on a blade concave side, a shroud front portion on a blade leading edge side and a shroud rear portion at a blade trailing edge side;

a second stage stationary blade extending between said outer shroud and said inner shroud, said blade having a blade wall, cooling holes passing through said blade wall, a blade leading edge portion, a blade trailing edge portion, a blade convex side, and a blade concave side;

a sleeve insert having air blow holes and inserted into said blade between said outer shroud and said inner shroud;

wherein said blade is constructed and arranged with said outer shroud, said inner shroud and said sleeve such that cooling air entering said outer shroud can flow through said insert, be blown out through said air blow holes of said insert and be blown out of said cooling holes in said blade wall of said blade, and be led into said inner shroud for cooling of said inner shroud and then discharged outside of inner shroud;

wherein said blade wall has a thickness at said blade leading edge portion in an area of 75% to 100% of blade height that is thicker toward said insert than in an area of 0% to 75% of the blade height, wherein 100% corresponds to an end of said blade wall at said outer shroud;

a plurality of ribs arranged along 0% to 100% of the height of said blade on an inner side of said blade wall on said convex side of said blade, said plurality of ribs extending in a direction transverse to the height of said blade and protruding toward said insert;

cooling passages in said outer shroud and said inner shroud arranged in said side portions thereof so that cooling air can flow there through from said shroud front portion of each of said outer shroud and said inner shroud to said shroud rear portion, and openings in said shroud rear portion of each of said outer shroud and said inner shroud so that the cooling air can be discharged outside of said shroud rear portion; and a plurality of cooling holes in said side portions of said inner shroud, communicating at one end thereof with said cooling passages of said inner shroud and opening at an other end thereof onto a face of said inner shroud along said side portions so that the cooling air can be blown out of said inner shroud through said plurality of cooling holes.

2. The gas turbine cooled second stage stationary blade arrangement of claim 1, wherein said inner shroud comprises a space having a plurality of pin fins extend up toward said outer shroud, said space being located at the entirety of said shroud front portion and along said side portions of said inner shroud, and said communicating with said cooling passages at said side portions of said inner shroud.

3. The gas turbine cooled second stage stationary blade arrangement of claim 1, wherein said cooling holes passing through said blade wall are provided only on said blade convex side.

4. The gas turbine cooled second stage stationary blade arrangement of claim 1, wherein said outer shroud and said inner shroud are each provided with flanges having a side surface constructed and arranged to coincide with faces of said side portions of said outer shroud and said inner shroud such that said outer shroud and said inner shroud can be connected by a bolt and nut connection on said flanges to two mutually adjacent shrouds in a turbine circumferential direction.

5. The gas turbine cooled second stage stationary blade arrangement of claim 1, wherein said outer shroud has a blade fitting portion including a blade leading edge portion and a blade trailing edge portion and a shroud thickness that is smaller at least at said blade leading edge portion and said blade trailing edge portion than other portions of said outer shroud.

6. The gas turbine cooled second stage stationary blade arrangement of claim 1, wherein said blade leading edge portion has a cross sectional shape in the transverse direction that is elliptical.

* * * * *